US005988408A

United States Patent [19]

Evans et al.

[11] Patent Number: 5,988,408

[45] Date of Patent: Nov. 23, 1999

[54] COMPREHENSIVE TOOL ORGANIZING SYSTEM

[76] Inventors: Elizabeth P. Evans; Glenn C. Evans, both of 35095 Juniper Ave., Yucaipa, Calif. 92399

[21] Appl. No.: 08/890,873

[22] Filed: Jul. 10, 1997

[51] Int. Cl.[6] ..... A47F 5/00

[52] U.S. Cl. ..... 211/70.6; 211/60.1; 211/87.01; 211/70.8

[58] Field of Search ..... 211/70.6, 60.1, 211/87.01, 70.8

[56] References Cited

U.S. PATENT DOCUMENTS

| | | | |
|---|---|---|---|
| 2,016,421 | 10/1935 | Eichner | 211/70.6 |
| 2,541,597 | 2/1951 | Midling | 211/70.6 X |
| 4,509,648 | 4/1985 | Govang et al. | 211/70.6 |
| 5,346,063 | 9/1994 | Chow | 211/70.6 X |
| 5,505,316 | 4/1996 | Lee | 211/70.6 |
| 5,638,964 | 6/1997 | Ernst | 211/70.6 |

*Primary Examiner*—Robert W. Gibson, Jr.
*Attorney, Agent, or Firm*—Michael J. Colitz, Jr.

[57] ABSTRACT

A comprehensive tool organizing system is provided having at least one vertical wall. A plurality of tool holders are positioned on the wall for organizing a plurality of tools. Such tool holders include a speed wrench holder having a square plate coupleable to the wall with a pair of vertical members situated on a front face of the plate adjacent side edges thereof. The vertical members has a plurality of notches formed therein at equal elevations. Such notches extend downwardly and rearwardly from a front surface of the associated vertical member to a rear surface thereof.

1 Claim, 4 Drawing Sheets

FIG. 8
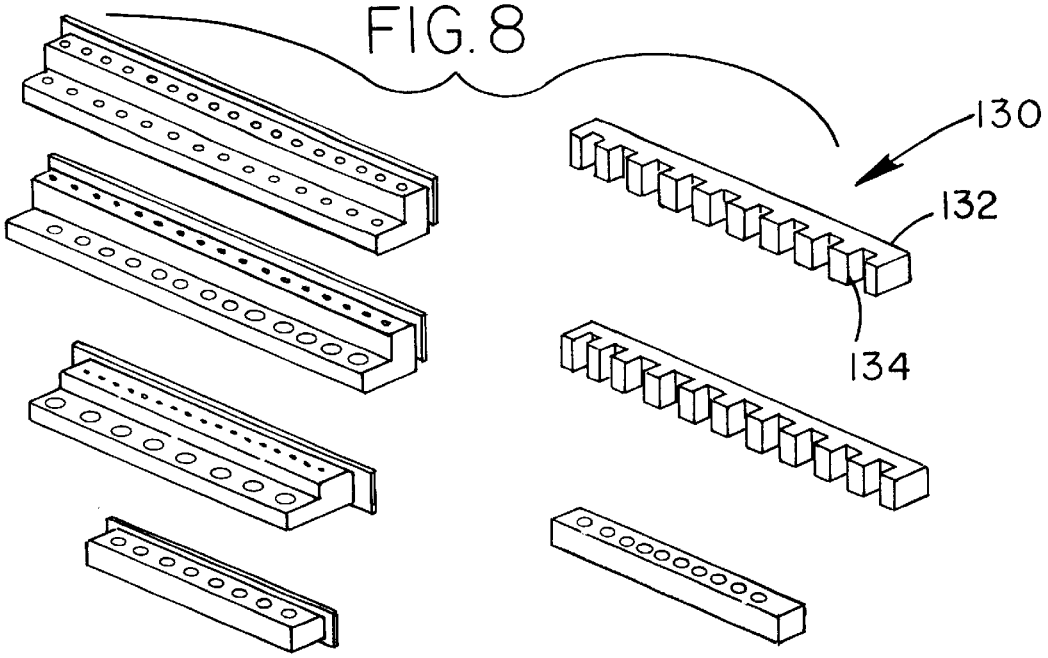
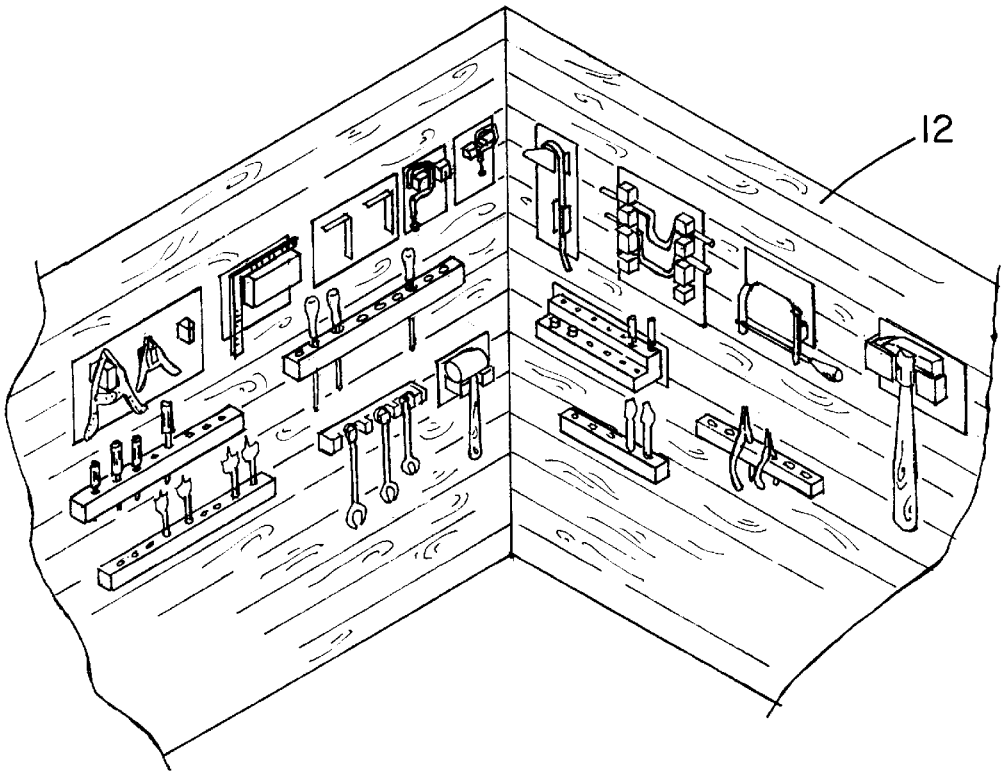
FIG. 9

COMPREHENSIVE TOOL ORGANIZING SYSTEM

BACKGROUND OF THE INVENTION

1. Field of the Invention

The present invention relates to a comprehensive tool organizing system and more particularly pertains to providing a comprehensive hand-tool organizer for preventing tools from cluttering.

2. Description of the Prior Art

The use of tool organizers is known in the prior art. More specifically, tool organizers heretofore devised and utilized for the purpose of organizing tools are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,050,733 to Brennan; U.S. Pat. No. 4,345,688 to De Boer; U.S. Pat. Des. 294,548 to Wallace; U.S. Pat. Des. 340,824 to Pujals, Jr.; U.S. Pat. No. 4,895,334 to Bajek et al.; and U.S. Pat. No. 4,140,256 to King.

In this respect, the comprehensive tool organizing system according to the present invention substantially departs from the conventional concepts and designs of the prior art, and in so doing provides an apparatus primarily developed for the purpose of providing a comprehensive hand-tool organizer for preventing tools from cluttering.

Therefore, it can be appreciated that there exists a continuing need for a new and improved comprehensive tool organizing system which can be used for providing a comprehensive hand-tool organizer for preventing tools from cluttering. In this regard, the present invention substantially fulfills this need.

SUMMARY OF THE INVENTION

In view of the foregoing disadvantages inherent in the known types of tool organizers now present in the prior art, the present invention provides an improved comprehensive tool organizing system. As such, the general purpose of the present invention, which will be described subsequently in greater detail, is to provide a new and improved comprehensive tool organizing system which has all the advantages of the prior art and none of the disadvantages.

To attain this, the present invention essentially comprises at least one vertical wall, as shown in FIG. 9. A speed wrench holder is provided including a square plate coupleable to the wall with a pair of vertical members situated on a front face of the plate adjacent side edges thereof. Note FIG. 1. The vertical members have a plurality of notches formed therein at equal elevations and extending downwardly and rearwardly from a front surface of the associated vertical member to a rear surface thereof. As shown in FIG. 1, a plurality of socket racks are included each having a rectangular strip coupleable to the wall. A plurality of blocks are situated thereon at different elevations thereby defining at least one step. Each block has a plurality of linearly aligned vertical bores formed therein along an entire length thereof. With reference now to FIG. 2, it can be seen that a coping saw holder is included with a rectangular plate coupleable to the wall. A thin retainer plate is spaced in parallel relationship with respect to the rectangular plate and has a block coupled therebetween. By this structure, an outer edge of the retainer plate defines an upper vertical flange.

Further shown in FIG. 2 is a dovetail rack. The dovetail rack includes a thin block with a rectangular vertical slot formed in a central extent thereof. Such slot resides in communication with a top surface and a single side surface of the block only. Next provided are a plurality of plane mounts each including a horizontally oriented shelf with an inboard edge coupleable to the wall. Each shelf has an upwardly extending peripheral lip integrally formed on an outboard edge and side edges of the shelf. As shown in FIG. 3, a plurality of hammer holders are provided each including a vertically disposed plate coupleable to the wall. A pair of spaced square rectilinear blocks are coupled to the plate each with a lip extending upwardly from an outboard upper edge thereof. Also included is a plurality of mallet holders each with a vertically disposed plate coupleable to the wall and having a pair of spaced square rectilinear blocks coupled thereto and extending outwardly therefrom. Illustrated in FIG. 4 is a level holder having a rear vertical plate coupleable to the wall. A pair of elongated shelves of different lengths and situated at different elevations are coupled to the vertical plate. Each of such shelves have a lip extending upwardly from the side edges and portions of a front edge thereof adjacent the side edges. FIG. 5 depicts a large square mount including a vertically disposed plate coupleable to the wall with a pair of spaced square rectilinear blocks coupled thereto. Each of the blocks are equipped with a lip extending upwardly from an outboard upper edge thereof. The plate further has a vertical tab coupled along one of the side edges thereof and extended outwardly in perpendicular relationship with the plate. As shown in FIG. 6, a plurality of screwdriver racks are provided. Each screwdriver rack includes a horizontally disposed rectangular block coupleable to the wall with a plurality of linearly aligned vertical circular apertures formed therein. With reference still to 6, a plurality of plier racks are included each with a horizontally disposed rectangular block coupleable to the wall with a plurality of linearly aligned vertical oval apertures formed therein. FIG. 6 also illustrates a punch set holder having a rear plate coupleable to the wall. The rear plate is equipped with a pair of horizontally oriented blocks situated at different elevations and having a plurality of axially aligned apertures formed therein. The punch set holder further includes a square block coupled to an upper one of the horizontally oriented blocks with an aperture in axial alignment with at least one of the apertures of both of the horizontally oriented blocks. A clamp holder is provided including a thin rear plate coupleable to the wall and a pair of spaced inverted L-shaped members coupled thereto and extending outwardly therefrom. Associated therewith is a spring clamp holder coupleable to the wall and having a rectangular rear plate with a plurality of spaced trapezoidal blocks coupled thereto. These blocks extend outwardly from the rear plate, wherein the trapezoidal blocks are of different sizes. FIG. 7 shows a wrecking bar rack including a rectangular plate with a pair of spaced upper blocks each with a lip coupled to an outboard end thereof and extending upwardly therefrom. The upper blocks includes a first block with a square lip and a second block with a trapezoidal lip. The wrecking bar rack further has a pair of spaced thin vertical lower strips coupled to the rectangular plate below the upper blocks, wherein the lower strips define a channel which extends between the upper blocks. Finally, a plurality of wrench racks are provided each including a rectangular block coupleable to the wall and having a plurality of square cut outs formed in a front edge thereof along an entire length thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved comprehensive tool organizing system which has all the advantages of the prior art tool organizers and none of the disadvantages.

It is another object of the present invention to provide a new and improved comprehensive tool organizing system which may be easily and efficiently manufactured and marketed.

It is a further object of the present invention to provide a new and improved comprehensive tool organizing system which is of a durable and reliable construction.

An even further object of the present invention is to provide a new and improved comprehensive tool organizing system which is susceptible of a low cost of manufacture with regard to both materials and labor, and which accordingly is then susceptible of low prices of sale to the consuming public, thereby making such comprehensive tool organizing system economically available to the buying public.

Still yet another object of the present invention is to provide a new and improved comprehensive tool organizing system which provides in the apparatuses and methods of the prior art some of the advantages thereof, while simultaneously overcoming some of the disadvantages normally associated therewith.

Still another object of the present invention is to provide a comprehensive hand-tool organizer for preventing tools from cluttering.

Lastly, it is an object of the present invention to provide a new and improved comprehensive tool organizing system is provided having at least one vertical wall. A plurality of tool holders are positioned on the wall for organizing a plurality of tools. Such tool holders include a speed wrench holder having a square plate coupleable to the wall with a pair of vertical members situated on a front face of the plate adjacent side edges thereof. The vertical members has a plurality of notches formed therein at equal elevations. Such notches extend downwardly and rearwardly from a front surface of the associated vertical member to a rear surface thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a perspective view of the tap and die, machine screw, pipe tap, open wrench, box wrench, and nut driver racks of the present invention.

FIG. 9 is a perspective view of the present invention in use.

Similar reference characters refer to similar parts throughout the several views of the drawings.

Description of the Preferred Embodiment

Figure 1:
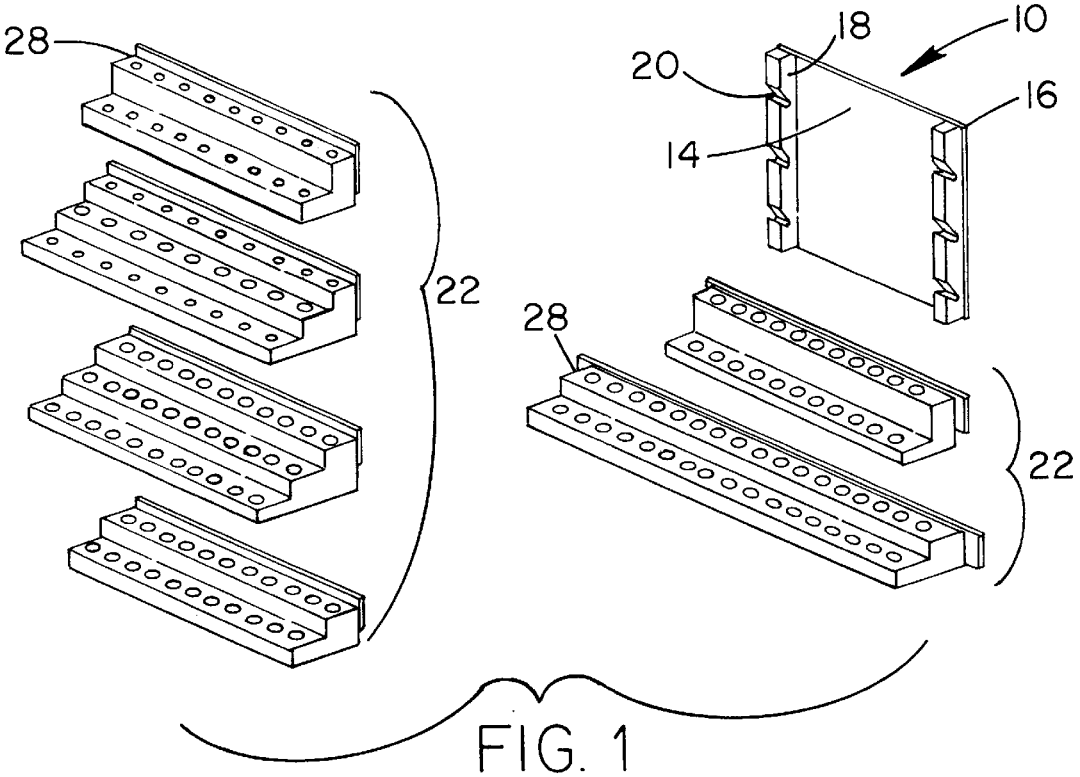
FIG. 1 is a perspective illustration of socket, accessory, and speed wrench racks of the present invention.

With reference now to the drawings, and in particular to FIG. 1 thereof, a new and improved comprehensive tool organizing system embodying the principles and concepts of the present invention and generally designated by the reference numeral 10 will be described.

The present invention, the new and improved comprehensive tool organizing system, is comprised of a plurality of components. Such components in their broadest context include a plurality of racks. Such components are individually configured and correlated with respect to each other so as to attain the desired objective.

More specifically, it will be noted that the system 10 of the present invention includes at least one vertical wall 12, as shown in FIG. 9. A speed wrench holder 14 is provided including a square plate 16 coupleable to the wall with a pair of vertical members 18 situated on a front face of the plate adjacent side edges thereof. Note FIG. 1. The vertical members have a plurality of notches 20 formed therein at equal elevations and extending downwardly and rearwardly from a front surface of the associated vertical member to a rear surface thereof.

As shown in FIG. 1, a plurality of socket and accessory racks 22 are included each having a rectangular strip 24 coupleable to the wall. A plurality of blocks 26 are situated thereon at different elevations thereby defining at least one step. Each block has a plurality of linearly aligned vertical bores 28 formed therein along an entire length thereof. It should be noted that the steps and bores are sized to accommodate a plurality of differently sized sockets.

Figure 2:
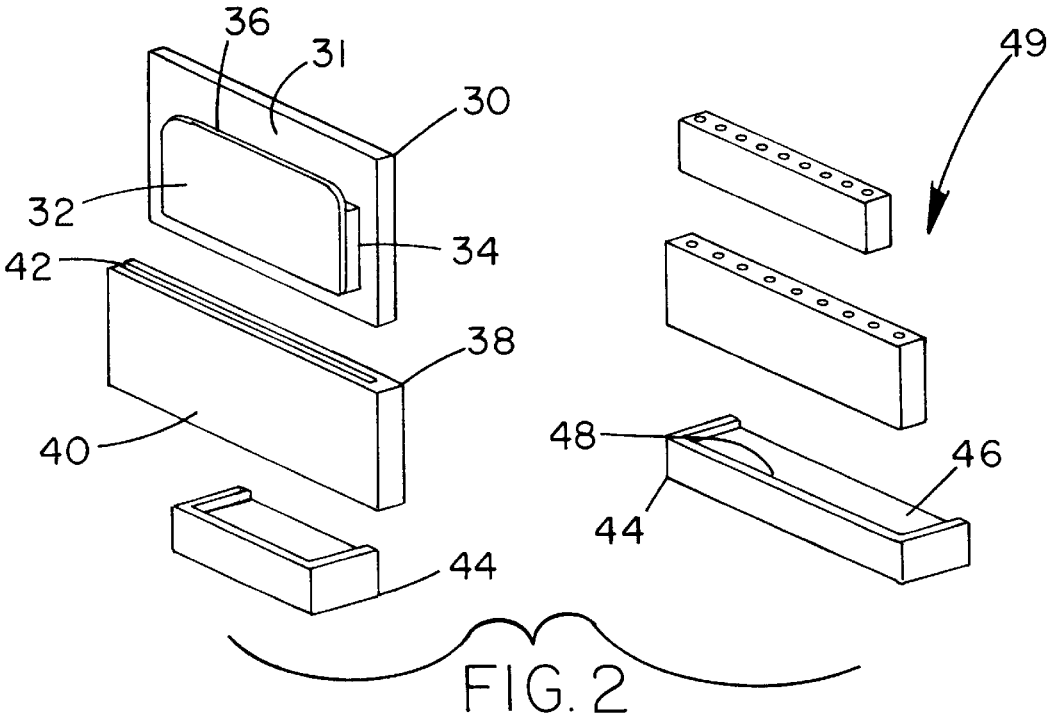
FIG. 2 is an illustration of the coping saw, dovetail, plane, bit rack and wood boring drill racks of the present invention.

With reference now to FIG. 2, it can be seen that a coping saw holder 30 is included with a rectangular plate 31 coupleable to the wall. A thin retainer plate 32 is spaced in parallel relationship with respect to the rectangular plate and has a block 34 coupled therebetween. By this structure, an outer edge of the retainer plate defines an upper vertical flange 36.

Further shown in FIG. 2 is a dovetail rack 38. The dovetail rack includes a thin block 40 with a rectangular vertical slot 42 formed in a central extent thereof. Such slot resides in communication with a top surface and a single side surface of the block only.

Next provided are a plurality of plane mounts 44 each including a horizontally oriented shelf 46 with an inboard edge coupleable to the wall. Each shelf has an upwardly extending peripheral lip 48 integrally formed on an outboard edge and side edges of the shelf. Shown in FIG. 2 is the bit rack and the wood boring drill rack 49.

Figures 3, 4, 5:
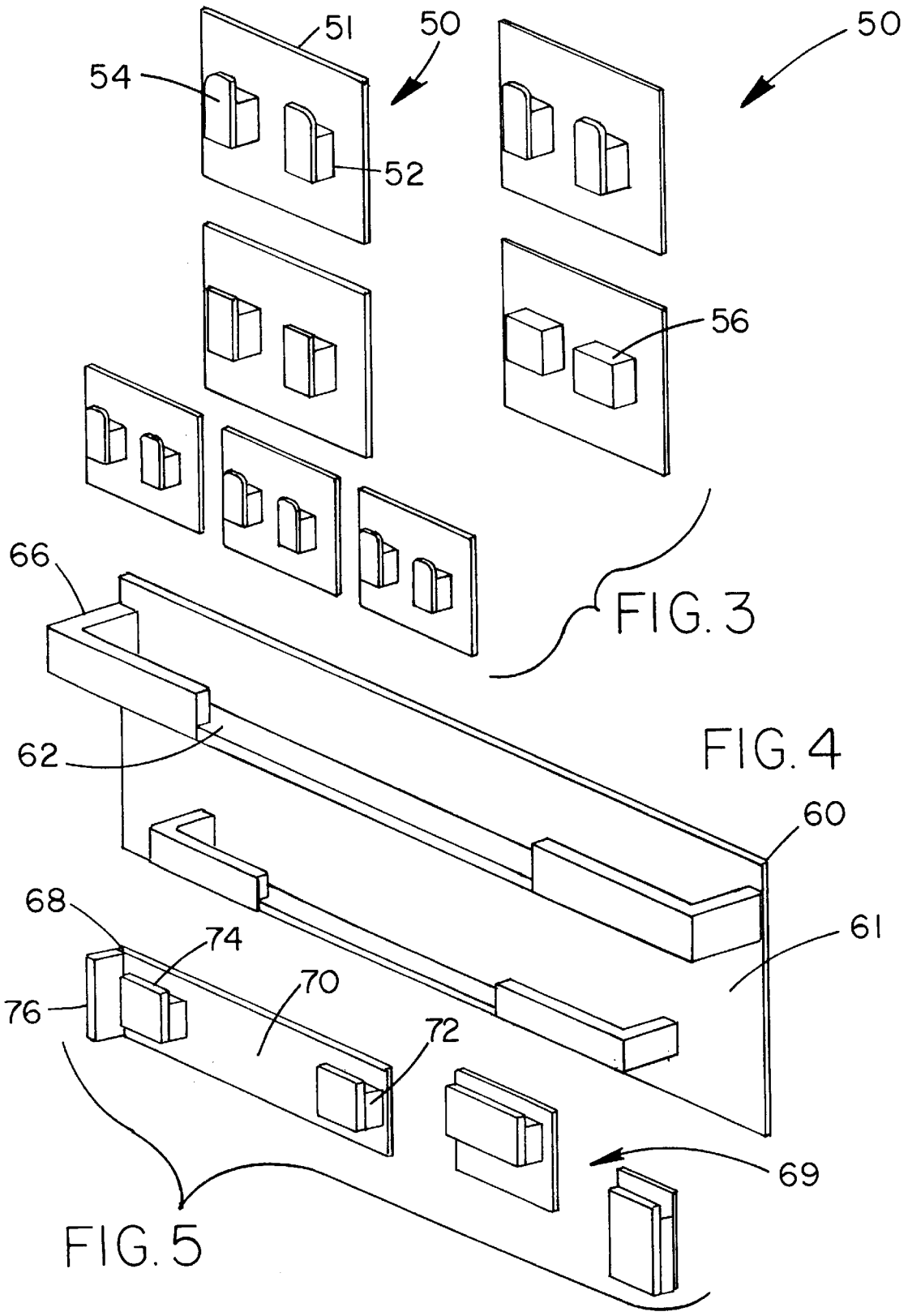
FIG. 3 is a perspective view of the hammer and mallet mounts of the present invention.
FIG. 4 is a perspective view of the plane rack of the present invention.
FIG. 5 is a perspective view of the square racks of the present invention.

As shown in FIG. 3, a plurality of hammer holders 50 are provided each including a vertically disposed plate 51 coupleable to the wall. A pair of spaced square rectilinear blocks 52 are coupled to the plate each with a lip 54 extending upwardly from an outboard upper edge thereof.

Also included is a plurality of mallet holders 56 each with a vertically disposed plate coupleable to the wall and having a pair of spaced square rectilinear blocks 58 coupled thereto and extending outwardly therefrom.

Illustrated in FIG. 4 is a level holder 60 having a rear vertical plate 61 coupleable to the wall. A pair of elongated shelves 62 of different lengths and situated at different elevations are coupled to the vertical plate. Each of such shelves has a lip 66 extending upwardly from the side edges and portions of a front edge thereof adjacent the side edges.

FIG. 5 depicts a large square mount 68 including a vertically disposed plate 70 coupleable to the wall with a pair of spaced square rectilinear blocks 72 coupled thereto. Each of the blocks are equipped with a lip 74 extending upwardly from an outboard upper edge thereof. The plate further has a vertical tab 76 coupled along one of the side edges thereof and extended outwardly in perpendicular relationship with the plate. It should be noted that a small and adjustable square rack 69 are also shown in FIG. 5.

Figure 6:
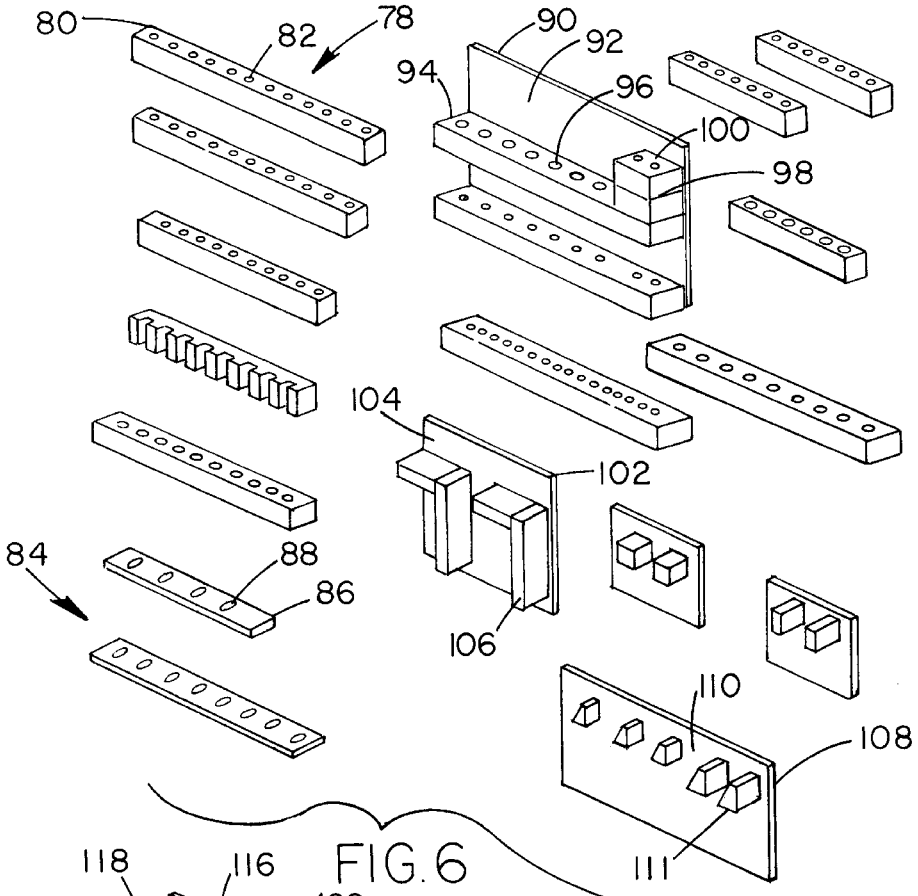
FIG. 6 is a perspective view of the plier, file, screwdriver, punch set, nail set, coal chisel, wood carving instrument, wood chisel, clamp, and spring clamp racks of the present invention.

As shown in FIG. 6, a plurality of screwdriver racks 78 are provided. Each screwdriver rack includes a horizontally disposed rectangular block 80 coupleable to the wall with a plurality of linearly aligned vertical circular apertures 82 formed therein.

With reference still to 6, a plurality of plier racks 84 are included each with a horizontally disposed rectangular block 86 coupleable to the wall with a plurality of linearly aligned vertical oval apertures 88 formed therein.

FIG. 6 also illustrates a punch set holder 90 having a rear plate 92 coupleable to the wall. The rear plate is equipped with a pair of horizontally oriented blocks 94 situated at different elevations and having a plurality of axially aligned apertures 96 formed therein. The punch set holder further includes a square block 98 coupled to an upper one of the horizontally oriented blocks with at least one aperture 100 in axial alignment with at least one of the apertures of both of the horizontally oriented blocks.

A clamp holder 102 is provided including a thin rear plate 104 coupleable to the wall and a pair of spaced inverted L-shaped members 106 coupled thereto and extending outwardly therefrom. Associated therewith is a spring clamp holder 108 coupleable to the wall and having a rectangular rear plate 110 with a plurality of spaced trapezoidal blocks 111 coupled thereto. These blocks extend outwardly from the rear plate, wherein the trapezoidal blocks are of different sizes. As set forth in the description of the Figures, various other types of mounts are also included in the present Figure.

Figure 7:
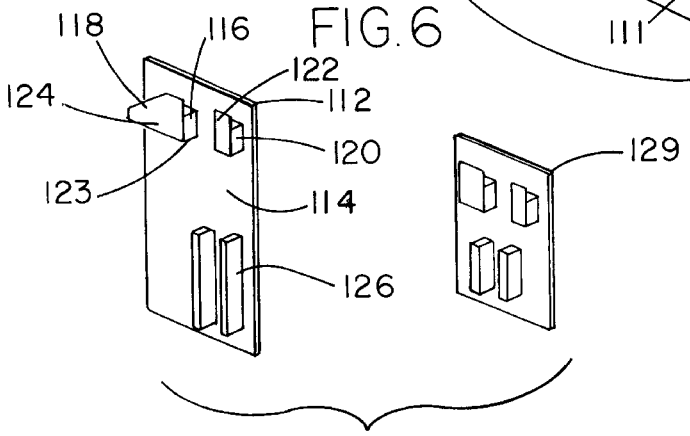
FIG. 7 is a perspective view of the wrecking bar and nail bar racks of the present invention.

FIG. 7 shows a wrecking bar rack 112 including a rectangular plate 114 with a pair of spaced upper blocks 116 each with a lip 118 coupled to an outboard end thereof and extending upwardly therefrom. The upper blocks includes a first block 120 with a square lip 122 and a second block with a trapezoidal lip 124. The wrecking bar rack further has a pair of spaced thin vertical lower strips 126 coupled to the rectangular plate below the upper blocks, wherein the lower strips define a channel 128 which extends between the upper blocks. A nail buddy bar 129 is also shown in FIG. 7.

Finally, a plurality of wrench racks 130 are provided each including a rectangular block 132 coupleable to the wall and having a plurality of square cut outs 134 formed in a front edge thereof along an entire length thereof. Note FIG. 8. As set forth in the description of the Figures, various other types of mounts and racks are also included in FIG. 8.

As shown in FIG. 9, the present invention affords a comprehensive hand-tool organizer for preventing tools from cluttering.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved comprehensive tool organizing system comprising, in combination:

at least one vertical wall;

a speed wrench holder including a square plate coupleable to the wall with a pair of vertical members situated on a front face of the plate adjacent side edges thereof, the vertical members having a plurality of notches formed therein at equal elevations and extending downwardly and rearwardly from a front surface of the associated vertical member to a rear surface thereof;

a plurality of socket racks each having a rectangular strip coupleable to the wall and a plurality of blocks situated at different elevations thereby defining at least one step, each block having a plurality of linearly aligned vertical bores formed therein along an entire length thereof;

a coping saw holder including a rectangular plate coupleable to the wall, a thin retainer plate spaced in parallel relationship with respect to the rectangular plate and having a block coupled therebetween whereby an outer edge of the retainer plate defines an upper vertical flange;

a dovetail rack including a thin block with a rectangular vertical slot formed in a central extent thereof, the slot residing in communication with a top surface and a single side surface of the block only;

a plurality of plane mounts each including a horizontally oriented shelf with an inboard edge coupleable to the wall, each shelf having an upwardly extending peripheral lip integrally formed on an outboard edge and side edges of the shelf;

a plurality of hammer holders each including a vertically disposed plate coupleable to the wall with a pair of spaced square rectilinear blocks coupled thereto each with a lip extending upwardly from an outboard upper edge thereof;

a plurality of mallet holders each including a vertically disposed plate coupleable to the wall with a pair of spaced square rectilinear blocks coupled thereto and extending outwardly therefrom;

a level holder having a rear vertical plate coupleable to the wall with a pair of elongated shelves of different lengths and situated at different elevations coupled to the vertical plate, each shelf having a lip extending upwardly from the side edges and portions of a front edge thereof adjacent the side edges;

a large square mount including a vertically disposed plate coupleable to the wall with a pair of spaced square rectilinear blocks coupled thereto each with a lip extending upwardly from an outboard upper edge thereof, the plate further having a vertical tab coupled along one of the side edges thereof and extending outwardly in perpendicular relationship with the plate;

a plurality of screwdriver racks each including a horizontally disposed rectangular block coupleable to the wall with a plurality of linearly aligned vertical circular apertures formed therein;

a plurality of plier racks each including a horizontally disposed rectangular block coupleable to the wall with a plurality of linearly aligned vertical oval apertures formed therein;

a punch set holder having a rear plate coupleable to the wall with a pair of horizontally oriented blocks situated at different elevations and having a plurality of axially aligned apertures formed therein, the punch set holder further including a square block coupled to an upper one of the horizontally oriented blocks with an aperture in axial alignment with at least one of the apertures of both of the horizontally oriented blocks;

a clamp holder including a thin rear plate coupleable to the wall and a pair of spaced inverted L-shaped members coupled thereto and extending outwardly therefrom;

a spring clamp holder coupleable to the wall and having a rectangular rear plate with a plurality of spaced trapezoidal blocks coupled thereto and extending outwardly therefrom, wherein the trapezoidal blocks are of different sizes;

a wrecking bar rack including a rectangular plate with a pair of spaced upper blocks each with a lip coupled to an outboard end thereof and extending upwardly therefrom, the upper blocks including a first block with a square lip and a second block with a trapezoidal lip, the wrecking bar rack further including a pair of spaces thin vertical lower strips coupled to the rectangular plate below the upper blocks, wherein the lower strips define a channel which extends between the upper blocks; and a plurality of wrench racks each including a rectangular block coupleable to the wall and having a plurality of square cut outs formed in a front edge thereof along an entire length thereof.

* * * * *